United States Patent [19]

Pouget

[11] 4,182,008

[45] Jan. 8, 1980

[54] BUCKLE FOR A SAFETY BELT

[75] Inventor: René Pouget, Levallois-Perret, France

[73] Assignee: Aciers et Outillage Peugeot, Audincourt, France

[21] Appl. No.: 791,075

[22] Filed: Apr. 26, 1977

[30] Foreign Application Priority Data

Apr. 28, 1976 [FR] France ..... 76 12529
Feb. 9, 1977 [FR] France ..... 77 03675

[51] Int. Cl.[2] ..... A44B 11/25
[52] U.S. Cl. ..... 24/230 A
[58] Field of Search ..... 24/230 A, 230 AP

[56] References Cited

U.S. PATENT DOCUMENTS

| | | | |
|---|---|---|---|
| 2,652,809 | 9/1953 | Foster | 24/230 A |
| 2,863,200 | 12/1958 | Miller et al. | 24/230 AP |
| 2,893,088 | 7/1959 | Harper et al. | 24/230 A |
| 3,177,547 | 4/1965 | Wisniewski | 24/230 A |

*Primary Examiner*—Kenneth Dorner

*Attorney, Agent, or Firm*—Sughrue, Rothwell, Mion, Zinn and Macpeak

[57] ABSTRACT

The buckle comprises a housing in which there is disposed a support for fixing to a retaining device of the safety belt and a device for locking a bolt member secured to a portion of the safety belt. The locking device is mounted on the support to pivot about a pivot axis and comprises at least one first abutment surface against which the bolt member is retained in the locked position. The first abutment surface is disposed in such manner in the locking device that a force exerted by the belt on the bolt member produces about the pivot axis a torque for releasing the bolt member. The locking device also comprises at least one second abutment surface, a stop member movably mounted in the support and a control member for moving and withdrawing the stop member. The second abutment surface is capable, under the action of said torque, of bearing against the stop member until it is withdrawn by the control member to release the locking device. The direction of movement of the stop member is substantially parallel to the second abutment surface.

7 Claims, 15 Drawing Figures

FIG. 4
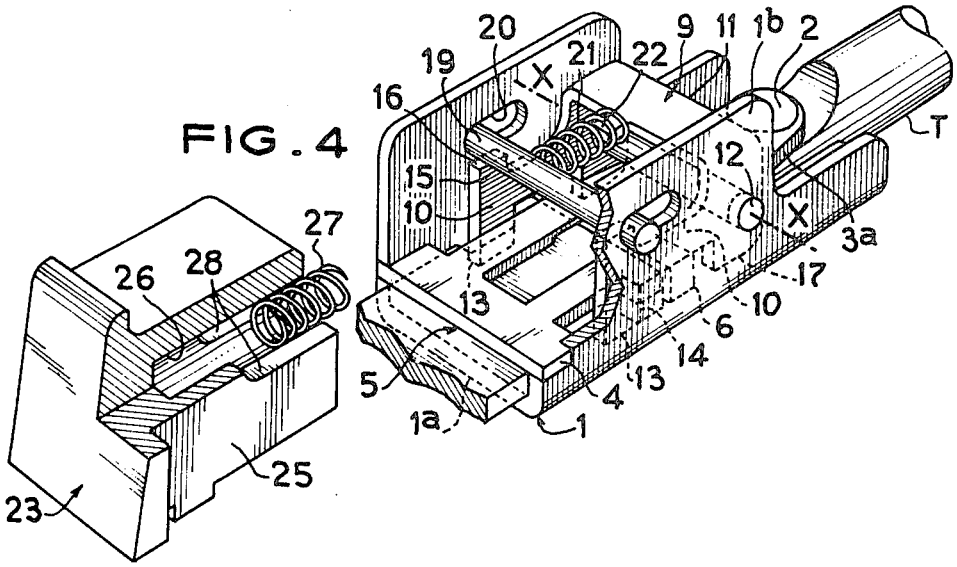
FIG. 5
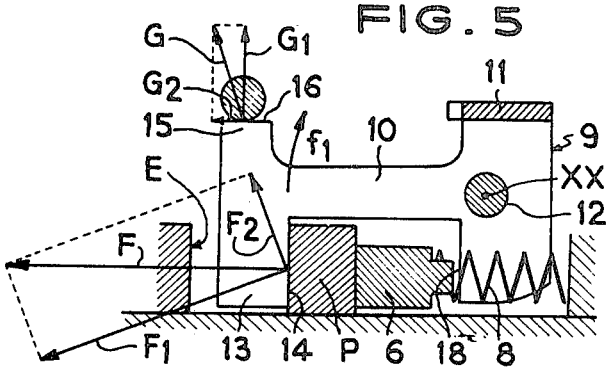
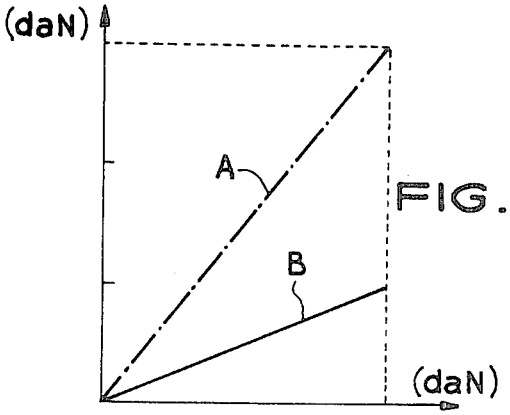
FIG. 6

BUCKLE FOR A SAFETY BELT

The present invention relates to a safety buckle for a safety belt adapted to attach a portion of the belt to retaining means, such as another portion of the belt or a fixed pin generally termed a "peduncle" through the medium of a tongue member forming a bolt member integral with the portion of the belt to be fastened. Such a buckle usually comprises a housing in which there is disposed a support adapted to be fixed to the retaining means and means for locking the bolt member which is mounted on the support to pivot about an axis and which has at least a first abutment surface against which the bolt member is retained in the locked position.

Various buckles of this type exist at the present time. It has found that these buckles have a drawback which resides in a considerable increase in the force which must be applied to the control button with increase in the pull exerted on the belt. This is particularly inconvenient, for example when a passenger of a vehicle must disengage himself when his vehicle, subsequent to an accident, has overturned so that the passenger remains as it were suspended from the belt. Thus it happens that for a pulling force on the belt of about 60 daN, the passenger must depress the control button of the buckle with a force of 25 daN which is practically impossible, above all in the state of mind of the passenger after the accident.

An object of the invention is to provide a buckle for a safety belt in which this drawback is eliminated in as much as the opening force increases in a proportion which is very small compared to that of the pull of the belt.

According to the invention, there is provided a buckle of the general type indicated hereinbefore, wherein the first abutment surface is placed in such manner on said locking means that a force exerted by the belt on the bolt member produces a torque about said axis for releasing said bolt member and the locking means comprises at least one second abutment surface which is adapted to bear, under the action of said torque, on a stop means which is movably mounted in said support and withdrawable by means of a control button to release said locking means, the direction of movement of said stop means being substantially parallel to said second abutment surface.

With these features, the force exerted by the belt on the bolt member, and consequently on the locking means, is reduced or geared down, or even eliminated, as concerns the control button, apart from friction between the members in contact, which facilitates the opening of the buckle in the case where, after a shock on a vehicle, the circumstances produce a durable tension on the belt.

Further features and advantages of the invention will be apparent from the ensuing description with reference to the accompanying drawings which are given solely by way of example and in which:

FIG. 4 is a partial exploded perspective view of the buckle shown in the preceding Figures, the outer housing being omitted;

FIG. 5 is a diagrammatic view illustrating the operation of the buckle just described;

FIG. 6 is a graph illustrating the most important advantage obtained with a buckle according to the invention;

Figure 1:
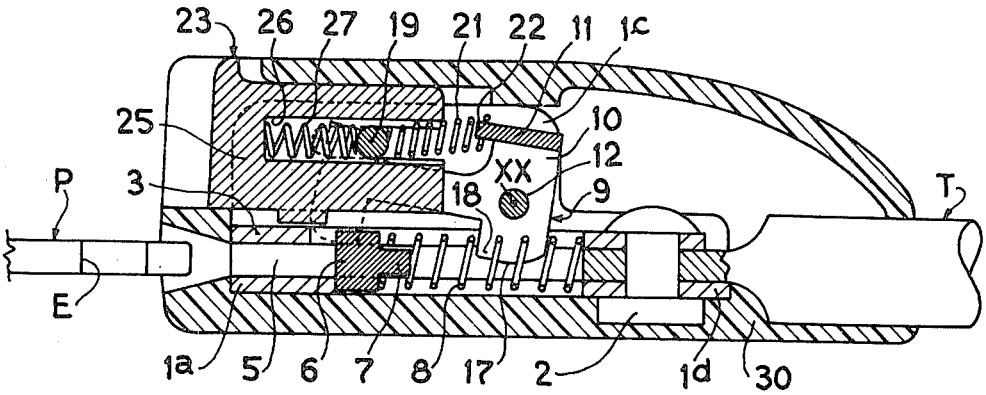
FIG. 1 is a longitudinal sectional and elevational view of a safety belt buckle according to the invention in the open position of the buckle.

In the embodiment shown in FIGS. 1 to 4, the buckle for a safety belt according to the invention comprises a generally stirrup-shaped metal support or plate 1 having a web 1*a* and two wings 1*b* and 1*c*, the web and the wings being extended on one side for receiving, as illustrated, a rivet 2 whereby retaining means, such as a rod T for securing to the chassis of the vehicle (not shown), may be rendered integral with the support 1. Such a rod T, also termed a "peduncle", is usually provided between two front seats of an automobile vehicle and thus constitutes the third point of a retaining device having a three-point belt. However, it must be stressed that this is merely an example since any fixing means for the buckle may be provided, such as for example a ring for fixing a belt portion (the case of a retaining device for a rear passenger for example).

Disposed between the wings 1*b* and 1*c* of the plate 1 and parallel to the bottom thereof, is a guide plate 3 which is fixed, on one hand, by lateral tabs 4 (FIG. 4) in notches of the wings of the plate and, on the other hand, by an extension 3*a* (which is traversed by the rivet 2), to an extension 1*d* of the web 1*a*. Thus there is formed between the web 1*a* of the plate 1 and the plate 3 a passageway 5 for the insertion of a tongue member P which constitutes a bolt member and is fixed to a movable portion of the safety belt which must be attached to the buckle. This bolt member P is provided with two lateral notches E so as to lock it in position. A guide slide 6 is disposed transversely in the passageway 5 and is constituted by preferably a block of plastics material which has a mounting lug 7 for an ejecting spring 8 for the bolt member P, this spring being disposed longitudinally in the passageway 5 and bearing on the extension 3*a* of the plate 3 and the extension 1*d* of the web 1*a* of the plate 1.

Disposed between the wings 1*b* and 1*c* of the plate 1 is a locking means 9 comprising two side walls 10 of identical shape, that is to say roughly in the shape of an H, which extend in a direction parallel to the wings 1*b* and 1*c* and are united by a connecting bar 11 which extends transversely and press-formed therewith. The locking means 9 is pivotally mounted between the wings 1*b* and 1*c* by means of a pin 12 having an axis X—X and extending transversely of the passageway 5 for the insertion of the bolt member P.

Each side wall of the locking means 9 comprises a locking nose portion 13 on which there is formed a first abutment surface 14 and which is introduced into the guide passageway 5 when the buckle is closed. This abutment surface 14 is therefore formed by the edge of the nose portion which faces the inner end of the passageway 5, that is to say toward the slide 6.

Each side wall 10 also has on the same side, but extending in the opposite direction, a heel 15 on which there is formed a second abutment 16 which extends in a direction parallel to the guide passageway 5 and is formed by the end edge of the heel 15. Each side wall 10 has adjacent the connecting bar 11 a tab 17 which extends roughly in a direction parallel to the nose portion 13 and has, in facing relation to the first abutment surface 14, a third abutment surface 18 for the locking means 9 constituted by the corresponding edge of this tab 17.

The buckle also comprises a stop means 19 for the locking means and this stop means cooperates with each one of the second abutment surfaces 16 of this locking means. The stop means 19 is formed by a pin which extends transversely of the passageway 5 and parallel to the axis X—X of the pin 12. It is slidable adjacent its two ends in elongated apertures 20 formed respectively in the wings 1*b* and 1*c* of the plate 1.

Disposed between the stop means 19 and the connecting bar 11 is a return spring 21 which is maintained in position in particular by means of a retaining tab 22 formed on the connecting bar 11.

A control knob or button 23 is also provided and is preferably constructed from a plastics material and caps by two lateral walls 24 (FIG. 3) the wings 1*b* and 1*c* of the plate 1 so as to be capable of sliding in a direction parallel to the guide passageway 5. This control button comprises a core 25 in which there is formed a blind aperture 26 housing a return spring 27 which bears, on one hand, against the inner end of the aperture 26 and, on the other hand, against the stop means 19. The latter extends transversely through the core 26 owing to the provision of two parallel recesses 28 which are formed longitudinally in the wall of the blind aperture 26. The stop means also extends through the walls 24 owing to the provision of recesses 29 which are respectively provided therein.

The buckle is provided with a housing 30 preferably of plastics material and made in two symmetrical parts which are assembled by welding or in any other appropriate manner. The housing 30 has not been shown in FIG. 4.

Figure 2:
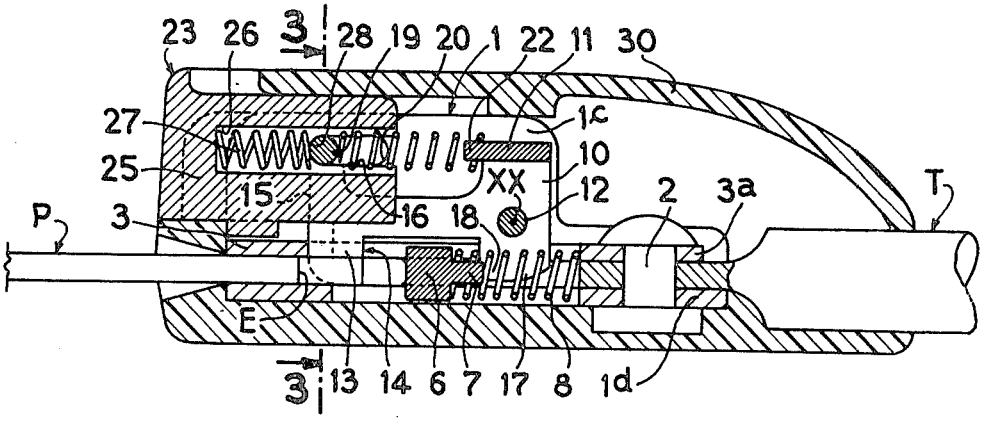
FIG. 2 is a view of said buckle in the closed position.
Figure 3:
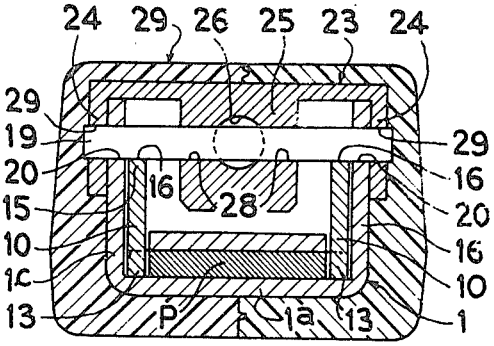
FIG. 3 is a cross-sectional view taken on line 3—3 of FIG. 2.

The operation of the buckle just described will now be examined with reference to FIGS. 1, 2 and 5.

When the buckle is open (FIG. 1), the locking means 9 is raised in an oblique position with respect to the guide passageway 5, the nose portion 13, and consequently the abutment urface 14, being in a withdrawn position. The locking means 9 is maintained in this position by the spring 21 which also applies the stop means 19 in the rounded portions formed respectively on the side walls 10 by the heels 15. The control button 23 is biased outwardly by the spring 27 whereas the slide 6 is in its advanced position under the action of the ejecting spring 8.

When the bolt member 9 is introduced into the passageway 5, its front edge urges the slide 6 rearwardly in opposition to the action of the spring 8. When the slide 6 comes into contact with the third abutment surface 18 of the tabs 17 of the locking means, the latter starts to pivot about the axis X—X and as at this instant the notches E of the bolt member respectively coincide with the nose portion 13, the latter can penetrate the guide passageway 5 and the notches E. At the same time, the heels 15 move back in front of the stop means 19 which, under the action of the spring 21, is urged into the openings 20 and places itself above the second abutment surfaces 16 of the locking means 9. This prevents any pivoting movement of the locking means toward its initial position and the bolt member 9 is consequently locked as it is urged outwardly by the ejecting spring 8 through the slide 6. However, the first abutment surfaces 14 prevent the bolt member P from coming out.

To open the buckle, the control button 23 is shifted rearwardly (toward the right as viewed in FIGS. 1 and 2) in opposition to the action of the spring 27 and also the spring 21, the latter being compressed through the stop means 19 which is urged back by the inner ends of the recesses 28 of the control button. Consequently, the heels 15 are released since the stop means 19 is disengaged from the abutment surfaces 16. Thereafter, the locking means can pivot toward the initial oblique position in which it is placed under the action of the ejecting spring 8 through the slide 6 and the front edge of the bolt member P which acts through the corresponding walls of the notches 4 on the abutment surfaces 14 of the nose portions 13 of the locking means.

In FIG. 5 it can be seen that a force F exerted by the belt on the bolt member 9 is applied to the first abutment surfaces 14 of the locking means. Such a force can be produced for example after an accident when, as a result of the overturning of the vehicle, the weight of the passenger is supported by the belt. With a conventional buckle, it is then practically impossible to unlock the belt, and consequently to disengage the passenger, owing to the fact that the force which must be exerted on the control button greatly exceeds that which the user can develop with a mere thrust of the thumb or index finger. This is illustrated in the graph shown in FIG. 6 where it can be seen from the curve A that for a pull on the belt equal to 60 daN the opening force can exceed 25 daN which is distinctly excessive for the average user.

Now, this serious drawback of conventional buckles is avoided in the buckle according to the invention owing to the particular design of the locking means 9 and stop means 19. FIG. 5 shows that the pulling force F of the belt can be divided into a component $F_1$ passing through the axis X—X about which the locking means 19 pivots, and a component $F_2$ perpendicular to the component $F_1$. The component $F_2$ exerts on the locking means an opening torque (direction of arrow $f_1$) and, in order to prevent this opening, the stop means 19 must therefore resist merely this component $F_2$ which is, as can be seen in FIG. 5, distinctly less than the total force F exerted by the belt.

The component $F_2$ therefore exerts through the locking means, and in particular the second abutment surfaces 16, a force G on the stop means 19 which may be divided into a component $G_1$ normal to these surfaces 16 and a component $G_2$ parallel to these surfaces. Apart from friction, the force $G_1$ does not have to be overcome when opening the buckle. It is therefore merely the component $G_2$ that the user has to compensate for (in addition to the forces of the springs 22 and 27 which are comparatively negligible) in order to unlock the belt. It can be seen that the force F exerted by the belt is reduced considerably (in practice by a factor of about 3) so that under the aforementioned difficult conditions, the opening of the buckle presents no problem to the user. The curve B of FIG. 6 obtained with a buckle of the type shown in FIGS. 1 to 4, clearly illustrates this advantage of the buckle according to the invention.

Note that the spring 21 performs a double function in that it maintains the locking means in the raised position when the buckle is open and it biases the stop means 19 to its stop position. Thus, the spring avoids an obturation of the guide passageway 5 by the locking means in the open position of the buckle, even if the latter is subjected to a shock at the moment of the insertion of the bolt member P into the passageway 5.

It can also be seen that the outer housing 30 participates in no way in the transmission of the forces in the buckle, it being a simple protective case which may be made from a moulded plastics material.

Figure 7:
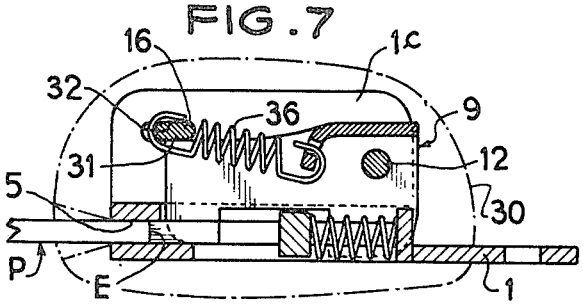
FIG. 7 is an elevational view, partly in section, of a buckle according to another embodiment of the invention.
Figure 8:
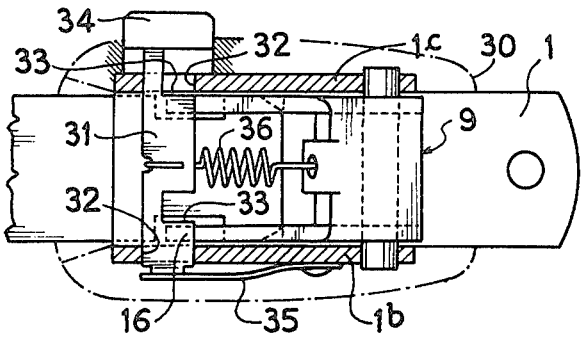
FIG. 8 is a top plan view of this buckle in the closed position thereof.
Figure 9:
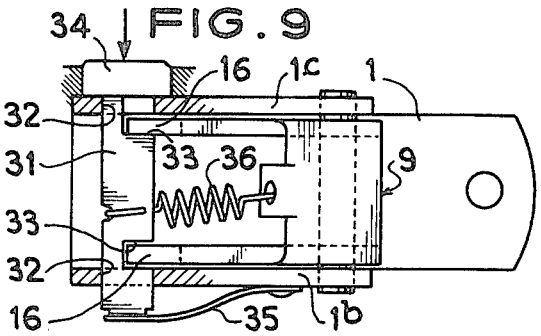
FIG. 9 is a top plan view of this buckle in the open position thereof.

In the embodiment shown in FIGS. 7 to 9, the buckle according to the invention comprises a lateral control which may be of utility in particular in the case where it is adapted to couple two belt portions which is the case in particular of belts for the rear passengers.

This embodiment is substantially identical to the foregoing embodiment except as concerns the arrangement of the stop means and the control abutment.

As illustrated, this buckle comprises a stop means 31 which is in the form of a tongue member slidably mounted in openings 32 of the wings 1*b* and 1*c* of the plate 1, the sliding being effected transversely of the guide passageway 5 but still in the direction parallel to the second abutment surfaces 16 of the locking means 9. The tongue member 31 comprises, for each of the side walls 10 of the locking means, a notch 33 and carries at one end of these ends a control button 34 which extends through the wall of the outer housing 30. A spring strip 35 biases the stop means 31 to its active position in which it maintains the locking means in the lower position thereof. On the other hand, the latter is biased through its raised position by a tension spring 36 which is hooked to the tongue member 31.

The buckle shown in FIGS. 7 to 9 operates in the same way as the buckle shown in FIGS. 1 to 4, except that the stop means 31 moves transversely of the guide passageway 5 whereas this movement occurs in a direction parallel to the second abutment surfaces 16 of the locking means 9. Apart from friction, the force for opening the buckle is practically zero since the force component which extends in a direction parallel to the surfaces 16 component $G_2$ in FIG. 5) makes a right angle with the direction of movement of the stop means or the control button 34.

Figure 10:
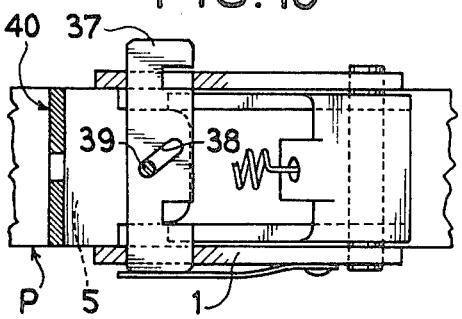
FIGS. 10 and 11 are top plan views of a buckle according to another embodiment of the invention, shown respectively in the closed position and open position thereof.
Figure 11:
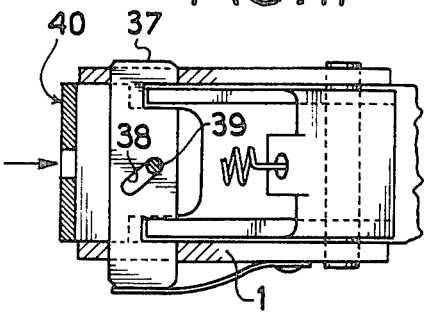

In the embodiment shown in FIGS. 10 and 11, the stop means 37 is also constituted by a tongue member disposed transversely of the guide passageway 5. However, in this case, the tongue member has an elongated aperture 38 which is inclined with respect to the longitudinal axis of the tongue member, a finger member 39 being inserted therein. This finger member is integral with a control button 40 which is guided in the plate 1 so as to move in the longitudinal direction of the guide passageway 5. As concerns the remainder of the buckle, it is identical to that shown in FIGS. 7 to 9.

The buckle shown in FIGS. 10 and 11 is therefore actuated in the same way as that shown in FIGS. 1 to 4. FIG. 10 shows it in the locked position whereas FIG. 11 shows it in the open position.

FIGS. 12 to 15 represent a belt buckle which, owing to a particularly advantageous improvement, permits, on one hand, increasing the force of resistance to pulling exerted by the bolt member on the buckle when the belt is under tension and, on the other hand, facilitating still more the opening of the buckle when the bolt member must be disengaged.

Consequently, according to the embodiment shown in FIGS. 12 to 15, the buckle comprises a metal support 101 which has the general shape of a stirrup having a web 101*a* and two wings 101*b* and 101*c*. The web of this stirrup is extended on one side at 101, this extension being provided with an aperture through which there extends a rivet 103 which serves to secure a ring A to which there may be attached a belt portion for example. The wings 101*b* and 101*c* are hollowed out adjacent the extension 102 and have in particular a recess 104 in which a respective lateral tab 105 of a locking plate 106 is received, the rivet 103 passing therethrough and thus rendering the support 101 integral with the ring A.

Formed in the web 101*a* of the yoke 101 is a T-shaped opening 107 the largest branch of which extends longitudinally in the support 101 on each side of the longitudinal plane of symmetry of the support 101.

The opening 107 acts as a guide for a slide 108 comprising a plate 108*a* which is disposed transversely between the wings 101*b* and 101*c* of the support 1. This plate is in one piece with a maintaining portion 108*b* provided with longitudinal flanges 108*c* of a longitudinal finger member 108*b* on which an ejecting spring 19 is engaged and, on the side thereof opposed to the maintaining portion 108*b*, two bosses 108*e* which are also disposed longitudinally. After having been engaged in the opening 107 of the web 101*a*, this slide is retained in this opening by the conjugate action of the flanges 108*c* and the plate 108*a*. The spring 109 which bears against the latter is maintained at its opposite end against the stack constituted by the extension 102, the ring A and the locking plate 106, the latter having for this purpose a press-formed portion 110.

The illustrated buckle also has a locking means 111 which has substantially the shape of a U the wings 111*a* of which extend in a direction parallel to those of the support 101. These wings 111*a* are respectively provided adjacent their free ends with oblong apertures 111*b* which extend in the longitudinal direction and serve for the passage of a pivot pin 112, the respective ends of which are received in corresponding circular apertures 113 provided in the wings 101*c* of the support 101. Also disposed adjacent their free ends, each wing 111*a* comprises two retaining tabs 111*c* which extend laterally and are adapted to maintain in position an elastically yieldable plate 114. The web 111*d* of the locking means 111 comprises, adjacent its edge facing the web 101*a* of the support 101, a tongue member 111*e* which defines, on the inside, that is to say on its side corresponding to the wings 111*d*, a first abutment surface 115 and, on the face thereof opposed thereto, an additional abutment surface 116. The surface 116 is adapted to cooperate with a complementary abutment surface 117 of the support 101, this complementary surface being defined by the transverse end edge of the opening 107 formed in the web 101*a* of the support 101. The edge 118 formed by the wings 111*b* and the web 111*d* of the locking means 111, constitutes two second abutment surfaces 119 with which there cooperates a pin 120 which is disposed transversely with respect to the support 101 and is received at the ends thereof in oblong apertures 121 which are formed longitudinally in the wings 101*b* and 101*c* of the support 101.

The elastic plate 114 has at the four corners thereof lugs 114*b* which cooperate respectively with retaining tabs 114*c* formed on the wings 111*a* of the locking means 111. This elastic plate also has, disposed adjacent one of its edges, an aperture 114*b* through which there extends a longitudinal pin 122 on which a spring 123 is mounted and which has a head 122*a* provided with a recess 122*b* for receiving the pin 120. The shape of this recess is such that the pin is rendered integral with this pin 122 and cannot be lost when the housing of the buckle deteriorates. At the edge thereof opposed to the aperture 114*b*, the elastic plate 114 has a cut-away portion 114*c* which is adapted to allow a passage for the spring 109.

Figure 12:
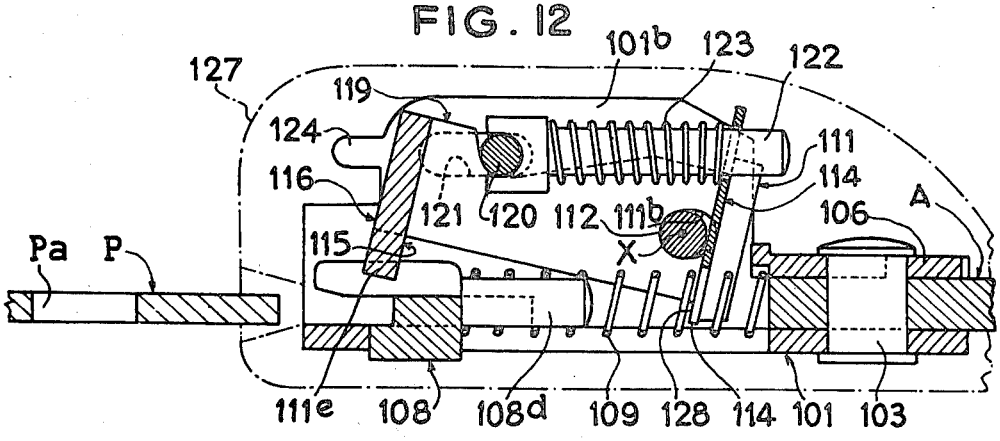
FIG. 12 is an elevational and sectional view of a buckle according to the invention in the open position thereof and including an improvement for increasing the force of the resistance to pulling.
Figure 13:
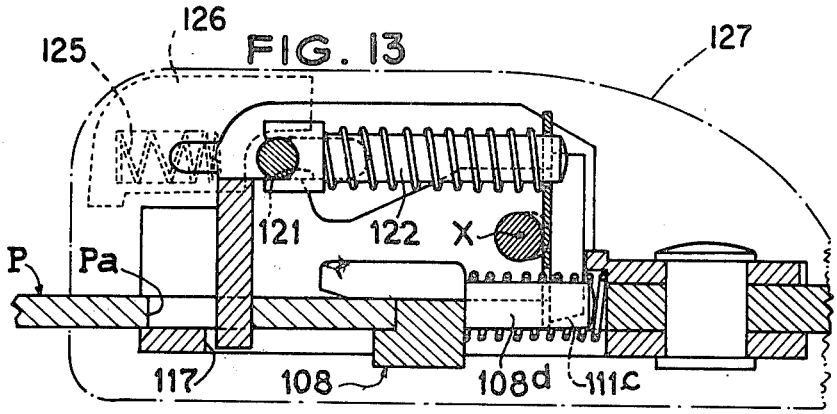
FIG. 13 is a view similar to FIG. 12, the buckle being closed.
Figure 14:
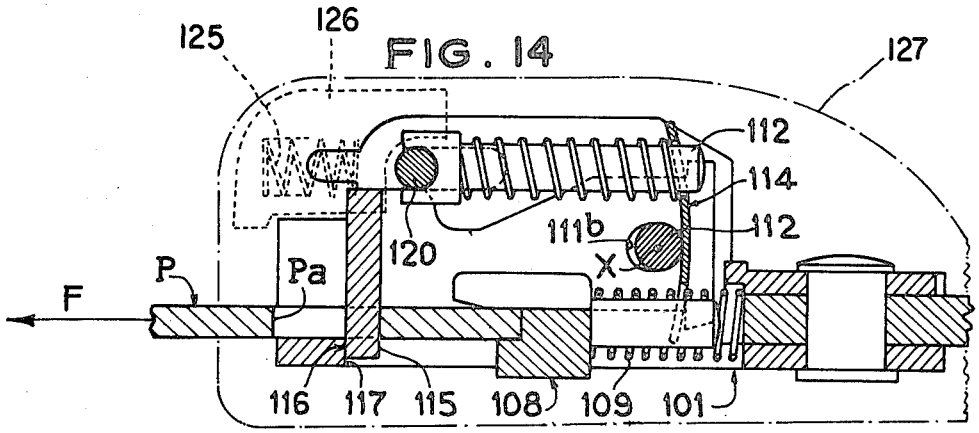
FIG. 14 is a view similar to FIG. 13, the buckle being subjected to a pulling force on the part of the belt which exceeds a given value.
Figure 15:
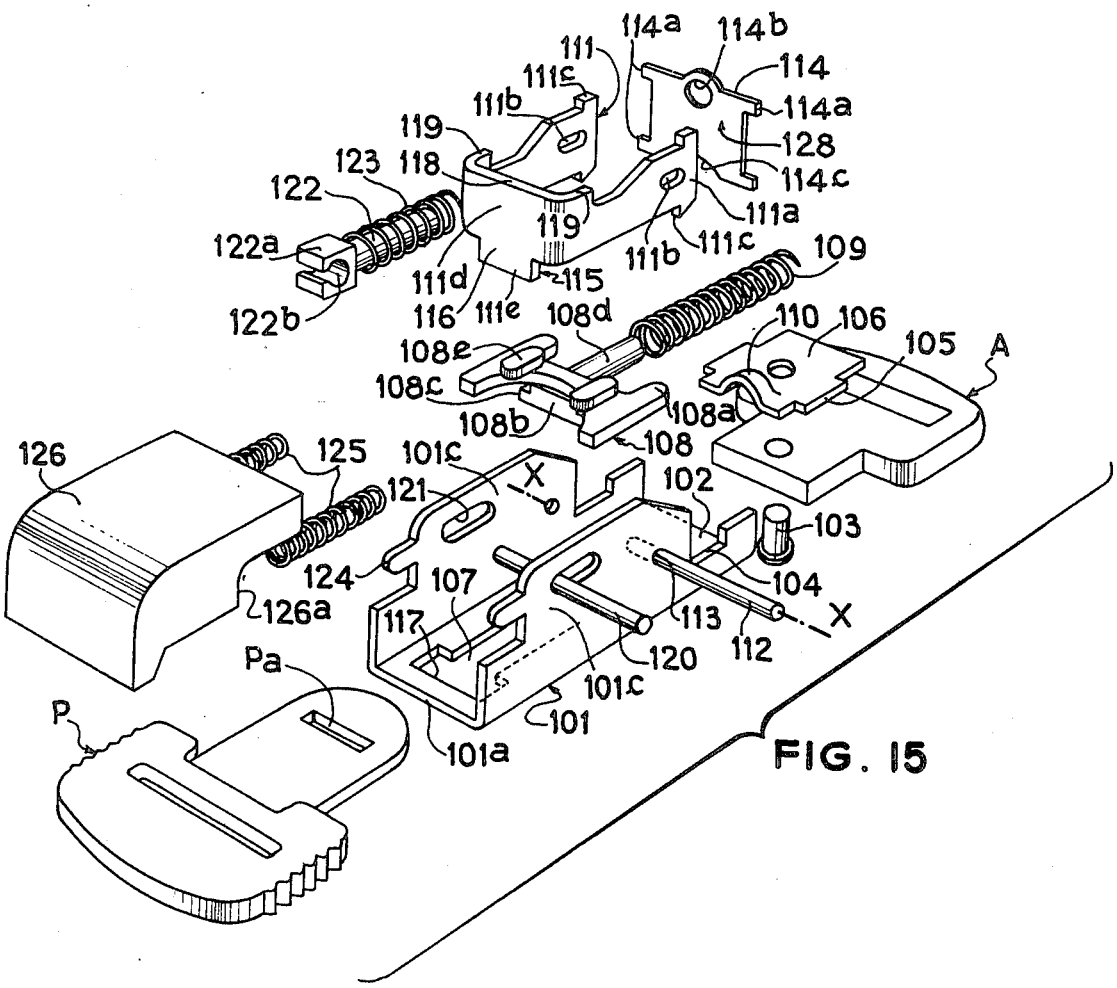
FIG. 15 is an exploded perspective view of the buckle shown in FIGS. 12 to 14.

Each wing 101*b* and 101*c* of the support 101 is also provided with a maintaining tab 124 which is disposed roughly in the extension of the oblong aperture 101 and on which there is engaged a return spring 125 of an unlocking button or knob 126 which is slidably mounted in the housing 127 of the buckle, as shown in FIGS. 12 to 14.

The unlocking button comprises, formed on two lateral wings, thrust surfaces 126*a* which are adapted to cooperate with the pin 120 for unlocking the buckle.

This buckle operates in the following manner:

When the buckle is open, the locking means 111 is raised in the oblique position relative to the web 101*a* of te support 101 so that the tongue portion 111*e* which defines the abutment surfaces 115 and 116 are outside the sliding passage of the bolt member P. The locking means is maintained in this position by the spring 123 which is under stress between the head 122*a* of the pin 122 and the elastically yieldable plate 114. The slide 108 is urged against the front edge 117 of the T-shape aperture formed in the web 101*a* of the support 101 by the spring 109. The plate 114 is not deformed and maintains the locking means 111 in its rear position.

When the bolt member P is inserted into the buckle, its front edge urges back the slide 108 in opposition to the action of the spring 109. At the moment the slide 108 comes in contact with the plate 114, which defines a third abutment surface 128 causing the closure of the buckle, the locking means starts to pivot about the axis X—X. The tongue portion 119 will thus penetrate the aperture Pa of the bolt member P while simultaneously the pin 120 is urged forwardly in the oblong apertures 121 and finally locks the locking means in position by its contact with the abutment surfaces 119. The buckle is then in the position shown in FIG. 13.

If a pull is now made on the buckle in the direction of arrow F (FIG. 14) which exceeds a given value which is a function of the elastic stiffness of the plate 114 and may be for example 200 kg, the locking means is pulled forwardly so that the surfaces 116 and 117 come into contact with each other while the pivot pin 112 of the locking means bears against the rear edge of the apertures 111*b* provided in the wings of the locking means. As shown in FIG. 14, the plate 114 is then bent and tends to oppose the contact between the surfaces 116 and 117.

If the pulling force F is sufficient, the plate 114 does not manage to oppose a sufficient resistance so that the surfaces 116 and 117 come into contact with each other. Under these conditions, the bolt member P is retained relative to the support 101 both by the tongue portion 111*e* and by the pivot pin 112. However, as soon as the force F ceases to be applied, the locking means is returned rearwardly under the action of the elastic force of the plate 114 so that the surfaces 116 and 117 disengage from each other. The buckle can then be easily unlocked by means of the control button 126.

It will be understood therefore that the buckle shown in FIGS. 12 to 15 has a selective resistance to a pulling force and only opposes its maximum resistance in cases where this resistance is really needed, that is to say upon a violent shock to which a person is subjected who is retained by the safety belt. As soon as the effects of the shock are no longer felt, the buckle still opposes a certain resistance, for example sufficient to maintain a person in a vehicle which has overturned, but does not oppose an effortless opening of the buckle for disengaging this person.

Having now described my invention what I claim as new and desire to secure by Letters Patent is:

1. A safety belt buckle for an automotive vehicle comprising in combination:

a support member, said support member defining a substantially rectilinear slideway which is adapted for receiving through one end portion thereof a bolt member having an aperture therein, said slideway having a plane in which said bolt member moves;

a locking member, said locking member being pivotally mounted on said support member, said locking member including a tongue member for securing said bolt member to said buckle in the locked position, said tongue member having a first abutment surface in contact with said bolt member in said aperture, said first abutment surface being substantially parallel to the direction of pivoting of said locking member, said tongue member being generally perpendicular to the plane of said slideway in the locked position;

means for causing said locking member to pivot upon insertion of said bolt member to move said tongue member into said aperture of said bolt member;

a stop member, said stop member being slidably mounted on said support member, said stop member being positioned to engage a second abutment surface of said locking member to restrain movement of said locking member in the locked position, said second abutment surface being substantially parallel to the plane of said slideway in said locked position;

a first spring, for urging said stop member into position against said second abutment surface; and a control member, said control member being operatively positioned to move said stop member out of engagement with said second abutment surface to permit said locking member to pivot so as to move said tongue member out of said aperture in said bolt member.

2. A safety belt buckle for an automotive vehicle, comprising in combination:

a support member having a planar base portion and two wing portions on opposite sides of said base portion extending perpendicular therefrom, said support member defining a substantially rectilinear slideway which is adapted for receiving through one end portion thereof a bolt member having an aperture therein;

a generally U-shaped locking member having side portions and an end portion, said side portions of said locking member being positioned between said wing portions and each of said side portions being pivotally connected to a corresponding wing portion of said support member;

said locking member having a tongue portion projecting from said end portion generally perpendicular to the plane of said base portion in the locked position;

means for causing said locking member to pivot in response to insertion of said bolt member for moving said tongue portion into locking engagement in said aperture of said bolt member;

a stop member, said stop member being slidably mounted in said wing portions and being slidable generally parallel to said base portion between a first position corresponding to the locked position and a second position corresponding to the unlocked position, said stop member in said first position abutting surfaces of said locking member which are generally parallel to the plane of said base portion and said stop member in said first position restraining movement of said locking member from said locked position; and a control member, said control member being slidable with respect to said support, said control member being operatively positioned to move said stop member from said first to said second position.

3. A safety belt buckle for an automotive vehicle having a body, the buckle being adapted to attach a portion of the belt to retaining means rigid with said body through a tongue member forming a bolt member and secured to the belt portion to be attached, said buckle comprising a housing, a support adapted to be rigid with said retaining means and means for locking the bolt member which locking means is mounted on the support to pivot about an axis, said locking means being movable in translation in a direction which is substantially perpendicular to the pivot axis thereof, said support defining a substantially rectilinear slideway, one portion of which is adapted for receiving said bolt member, said locking means defining at least one first abutment surface against which abutment surface the bolt member is retained in the locked position, said at least one abutment surface extending in a plane which is substantially transverse with respect to said slideway, facing the end of the slideway opposite to said one end of the latter and being disposed in such manner on said locking means that a force exerted by the belt on the bolt member produces about said axis a torque for releasing said bolt member, said rectilinear slideway being substantially aligned with the direction of said force, the locking means comprising at least one second abutment surface, said buckle further comprising a stop means movably mounted in said support and so arranged as to be able to engage said second abutment surface and to preclude pivotable movement of said locking means, and a control member movably mounted on said support and operatively connected to the stop means, the second abutment surface being capable under the action of said torque of bearing against the stop means until it is disengaged from said second abutment surface by the control member to release said locking means, the direction of movement of said stop means being substantially parallel to said second abutment surface, said buckle further comprising a supplementary abutment surface formed on said support and at least one complementary abutment surface capable of being applied, under the action of said force producing a translation of said locking means, against the supplementary abutment surface, and elastically yieldable means which tend to oppose contracting between said supplementary surface and said complementary abutment surface.

4. A buckle as claimed in claim 3, wherein a pivot pin pivotally mounts said locking means on said support and said locking means defines at least one oblong aperture having a longitudinal dimension which is perpendicular to the pivot axis and into which aperture said pivot pin extends.

5. A buckle as claimed in claim 4, wherein said elastically yieldable means comprise a plate which is parallel to said pivot axis and bears against said pin, said plate being retained on the locking means and being capable of being deformed elastically when the locking means moves in translation on said pin.

6. A buckle as claimed in claim 3, wherein said support is a stirrup having a web and two wings interconnected by said web and through which wings said pivot axis extends, a T-shaped slot provided in said web having an edge which defines said complementary abutment surface, and said locking means is in the form of an U-shaped member having wings which are disposed parallel to said wings of said support and a web which is disposed perpendicular to said wings of said support, the web of said locking means being provided with a tongue portion which extends along an edge of the U-shaped member opposed to an edge of the U-shaped member defining said second abutment surface, said tongue portion defining said first abutment surface on a first face of the tongue portion facing said pivot axis of the locking means, a second face of the tongue portion opposed to said first face defining said additional abutment surface.

7. A buckle as claimed in claim 6, wherein said elastically yieldable means comprise a plate which is parallel to said pivot axis and bears against said pin, said plate being retained on the locking means and being capable of being deformed elastically when the locking means moves in translation on said pin, and tabs formed on each side of the elastically yieldable plate on free ends of the wings of the locking means retain said elastically yieldable plate on said wings of the locking means.

* * * * *